US006994655B2

(12) United States Patent
Chu

(10) Patent No.: US 6,994,655 B2
(45) Date of Patent: Feb. 7, 2006

(54) HORIZONTAL BAR

(76) Inventor: Walt Chu, 7F, No. 29-3, Sec. 4. Jen-Ai Rd., Taipei (TW)

( * ) Notice: Subject to any disclaimer, the term of this patent is extended or adjusted under 35 U.S.C. 154(b) by 426 days.

(21) Appl. No.: 10/409,166

(22) Filed: Apr. 9, 2003

(65) Prior Publication Data

US 2004/0204292 A1 Oct. 14, 2004

(51) Int. Cl.
*A63B 1/00* (2006.01)
*A63G 9/04* (2006.01)

(52) U.S. Cl. ..... 482/38; 482/24; 482/35; 482/87; 472/118

(58) Field of Classification Search ..... 482/23, 482/24, 33–43, 83, 86, 87, 95–97, 100, 137, 482/143; 472/118, 135; D21/679, 823, 797; 248/214; 182/164, 104
See application file for complete search history.

(56) References Cited

U.S. PATENT DOCUMENTS 501,950 A * 7/1893 Leo ..... 182/164
715,530 A * 12/1902 Wallace ..... 482/38
950,100 A * 2/1910 Gough ..... 482/37
2,817,522 A * 12/1957 Margulies ..... 482/145
2,932,509 A * 4/1960 Zinkin ..... 482/97
2,977,118 A * 3/1961 Farkas ..... 482/35
3,716,232 A * 2/1973 Johnson et al. ..... 482/40
6,394,932 B1 * 5/2002 Chu ..... 482/38
6,749,549 B1 * 6/2004 Chu ..... 482/148
6,802,800 B1 * 10/2004 Hobson ..... 482/97

FOREIGN PATENT DOCUMENTS

GB 25465 * 12/1903

* cited by examiner

*Primary Examiner*—Jerome W. Donnelly
*Assistant Examiner*—Victor K. Hwang
(74) *Attorney, Agent, or Firm*—Rabin & Berdo, P.C.

(57) ABSTRACT

A horizontal bar includes two side supports, a top bar, and a swing member. The side supports are provided at upper ends with two symmetrical locating holes, through which two outer ends of the top bar are extended to thereby connect the top bar to the side supports. The swing member includes horizontally paralleled upper and lower bars connected to each other via a plurality of connecting plates vertically extended between the upper and lower bars. The upper bar is a hollow tubular member put around the top bar, and the lower bar is covered with a sleeve. The horizontal bar includes simple parts that can be easily assembled and disassembled, and can be connected to other types of sporting goods for more kinds of exercises.

8 Claims, 4 Drawing Sheets

HORIZONTAL BAR

FIELD OF THE INVENTION

The present invention relates to a horizontal bar, and more particularly to a sectional horizontal bar including simple parts that can be easily assembled and disassembled, and being adapted to connect to other types of sporting goods for more kinds of exercises.

BACKGROUND OF THE INVENTION

A conventional horizontal bar mainly includes two simple uprights with a top bar transversely extended between upper ends of the two uprights. A user may grip at the top bar to do different motions, such as pulling up, swinging to and fro, etc. To ensure that the horizontal bar has sufficient structural strength and stability for use, the two uprights are normally buried into the ground by a proper depth and the top bar is welded to the uprights. A horizontal bar with the above-described fixed structure is more suitable for erecting and using outdoors and could not be easily moved according to actual need.

U.S. Pat. No. 6,394,932 granted to the same inventor of the present invention discloses a sectional horizontal bar that could be advantageously disassembled for relocation and may function not only as a horizontal bar, but also a parallel bar. The horizontal bar disclosed in U.S. Pat. No. 6,394,932 mainly includes two side supports, two curved tubes, two top carriers, and a top bar. Each of the two side supports includes two vertically paralleled and spaced posts, which are connected at a middle portion to each other by a middle crossbar. The side support is also provided at upper and lower portions with pivotally turnable upper and lower curved braces, respectively, at an upper end with upward projected receiving holes, and at a lower end with forward and rearward projected receiving holes. Each of the two curved tubes has two reduced ends to form two insertion heads for inserting into the receiving holes at the lower ends of the two side supports, so that the two curved tubes are connected to the bottom of the side supports to separately extend from a front and a rear side thereof and therefore increase a contact area between the horizontal bar and a floor or the ground on which the horizontal bar is positioned. Each of the two top carriers is formed from two bars having a joined upper end and two parted lower ends. The parted lower ends of the top carriers are reduced to provide insertion heads for inserting into the upward projected receiving holes at the upper ends of the side supports, and the joined upper ends of the two top carriers are provided with two receiving holes for receiving and locating two outer ends of the top bar. Two metal rings are mounted around a middle portion of the top bar for connecting a handgrip thereto. When the upper and the lower curved braces provided on the two side supports are pivotally turned outward at the same time, a user may grip at the handgrip below the top bar to do horizontal bar exercises. And, when the upper and the lower curved braces provided on the two side supports are pivotally turned inward at the same time, a user may grip at the two upper braces between the two side supports to do parallel bar exercises.

The sectional horizontal bar disclosed in U.S. Pat. No. 6,394,932 includes complicated parts and components. To assemble the whole horizontal bar for use, an outer sleeve is first put around the handgrip and two metal rings are mounted to two outer ends of the handgrip for the handgrip to connect to the top bar via the metal rings that are mounted near two outer ends of the top bar, and then, the top bar is screwed to the top of the two side supports. The numerous complicated parts and components disadvantageously result in troublesome and time-consuming assembling and disassembling of the horizontal bar.

It is therefore an object of the invention to develop an improved sectional horizontal bar to overcome the above-mentioned problems.

SUMMARY OF THE INVENTION

A primary object of the present invention is to provide a horizontal bar that includes reduced number of simplified parts and components and can therefore be easily and quickly assembled and disassembled.

To achieve the above and other objects, the horizontal bar of the present invention mainly includes two side supports, a top bar, and a swing member. The side supports are provided at upper ends with two symmetrical locating holes, through which two outer ends of the top bar are extended to thereby connect the top bar to the side supports. The swing member includes horizontally paralleled upper and lower bars connected to each other via a plurality of connecting plates vertically extended between the upper and lower bars. The upper bar is a hollow tubular member put around the top bar, and the lower bar is covered with a sleeve.

With the above arrangements, the horizontal bar includes simple parts that can be easily assembled and disassembled, and can be connected to other types of sporting goods for more kinds of exercises.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
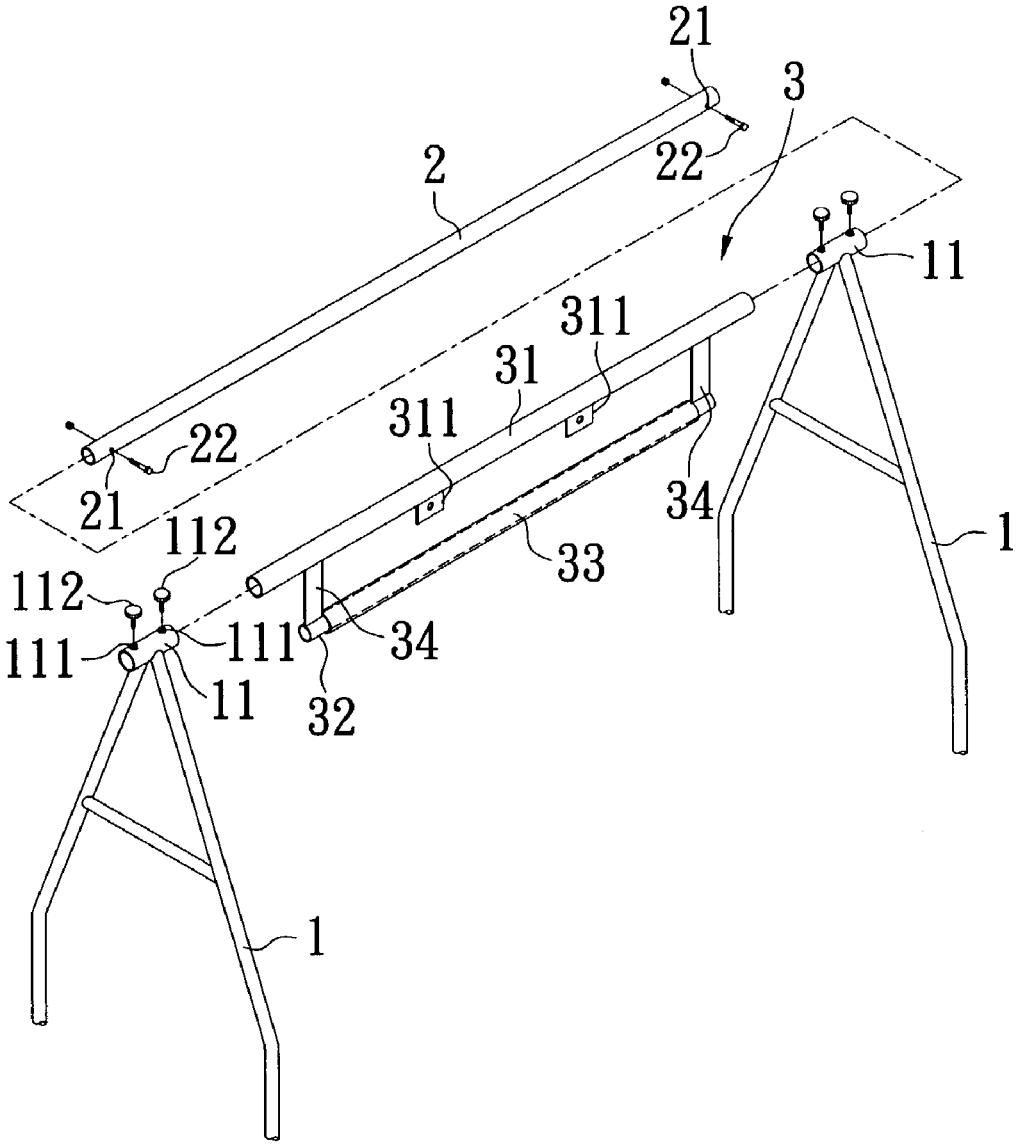
FIG. 1 is an exploded perspective view of a horizontal bar according to the present invention.
Figure 2:
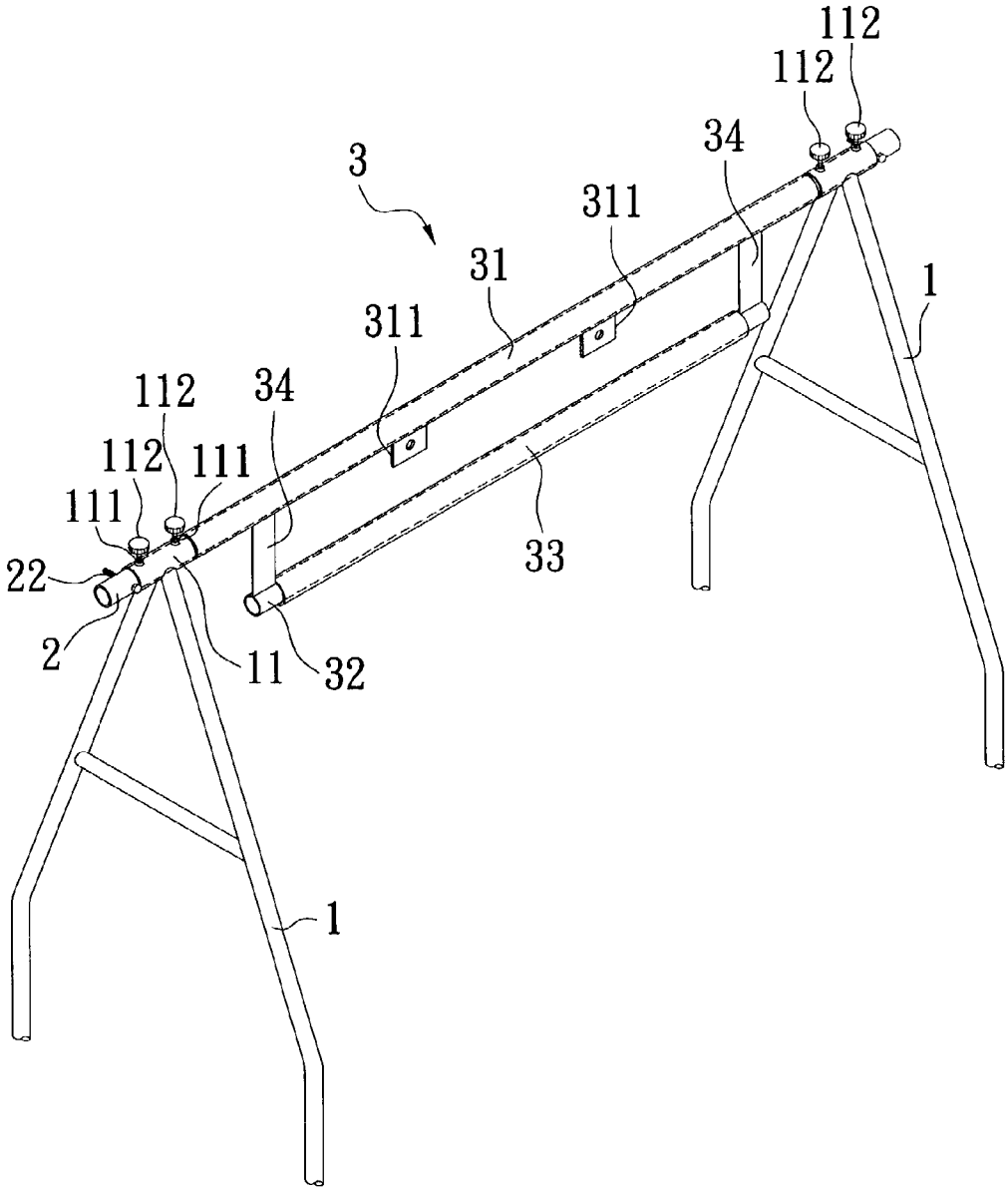
FIG. 2 is an assembled perspective view of the horizontal bar of FIG. 1.

Please refer to FIGS. 1 and 2 that are exploded and assembled perspective views, respectively, of a horizontal bar according to the present invention. As shown, the horizontal bar of the present invention mainly includes two symmetrical side supports 1, a top bar 2, and a swing member 3.

Each of the two side supports 1 has a locating hole 11 defined in a locating sleeve connected to a top of the side support 1. Threaded holes 111 are axially spaced on the locating sleeve for screws 112 to extend therethrough.

The top bar 2 is connected to the top of the two side supports 1 by extending two ends through the locating holes 11 defined in the two locating sleeves, so that the top bar 2 is transversely extended between the tops of the two side supports 1. The top bar 2 is provided near each outer end with two diametrically opposite holes 21.

The swing member 3 includes two horizontally paralleled and spaced bars, namely, an upper bar 31 and a lower bar 32 connected to each other by two connecting plates 34 vertically extended between them. The upper bar 31 is a hollow tubular member for putting around the top bar 2, and the lower bar 32 has a sleeve 33 put thereon.

To erect the horizontal bar of the present invention, first the top bar 2 is extended through the upper bar 31, and then two outer ends of the top bar 2 are extended through the two locating holes 11 at the top of the two side supports 1. Thereafter, the screws 112 are threaded into the threaded the locating sleeves to firmly press against and thereby hold the top bar 2 in place between the two side supports 1 with the holes 21 near two outer ends of the top bar 2 located beyond the two locating holes 11. Finally, a pin 22 is extended across the two opposite holes 21 near each end of the top bar 2 to prevent the top bar 2 from axially moving relative to the side supports 1, to complete the erection of the whole horizontal bar.

The swing member 3 is connected to the top bar 2 by extending the top bar 2 through the hollow upper bar 31. That is, the hollow upper bar 31 is put around the top bar 2 such that the whole swing member 3 is rotatable relative to the top bar 2. The sleeve 33 is also rotatably put around the lower bar 32 of the swing member 3, so that a user may grip at the sleeve 33 with two hands to swing to and fro.

Figure 3:
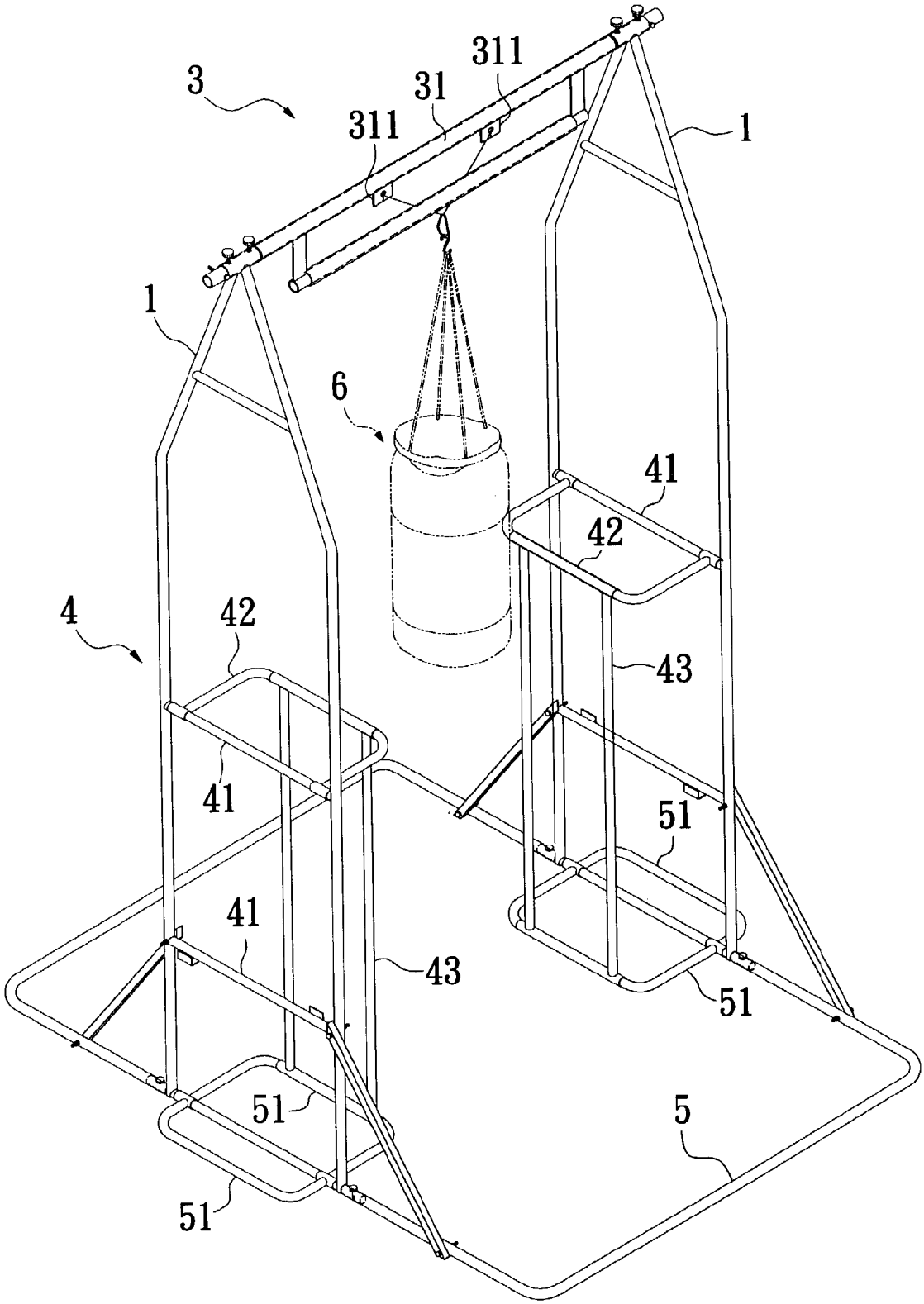
FIG. 3 is a perspective view showing the use of the horizontal bar of the present invention to hold a sand bag for practicing boxing.
Figure 4:
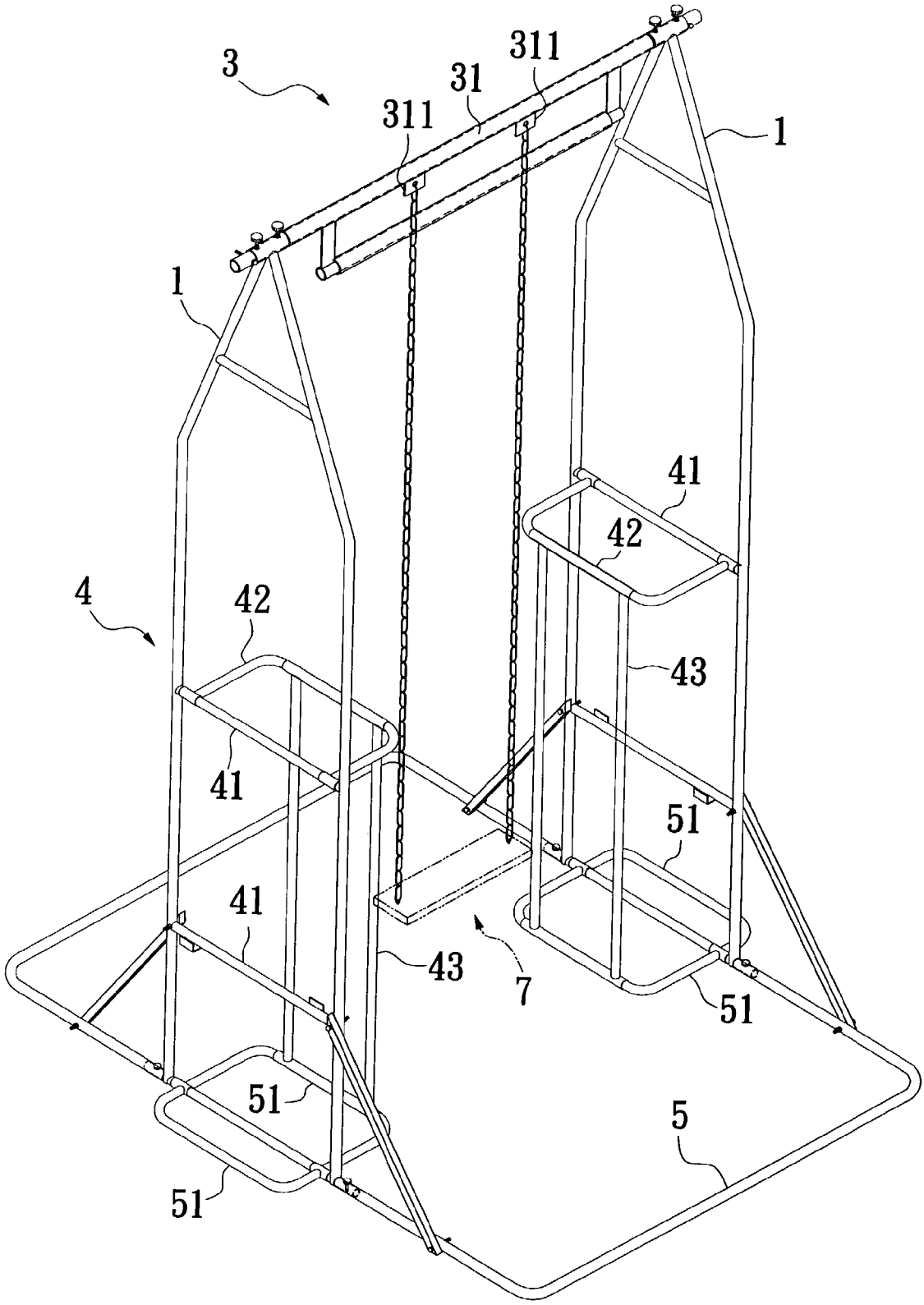
FIG. 4 is a perspective view showing the use of the horizontal bar of the present invention to hold a swing.

Please refer to FIGS. 3 and 4 that show the use of the horizontal bar of the present invention to hold a sand bag 6 and a swing 7, respectively. As shown, each side support 1 of the horizontal bar of the present invention is a substantially A-shaped frame to connect at two spaced lower ends to an upright stand 4. The upright stand 4 includes two vertically paralleled bars spaced by upper and lower crossbars 41 located near a middle portion of the upright stand 4. A generally square base 5 is fixedly connected to lower ends of the two upright stands 4 for the whole horizontal bar to stably stand on a floor or the ground. Two framed feet 51 are provided at a middle portion of each lateral side of the square base 5 to separately extend inward and outward. Two generally U-shaped handgrips 42 are separately fixedly connected to the two upper crossbars 41 of the two upright stands 4 to project inward therefrom and correspond to the two framed feet 51. Two vertically spaced supporting posts 43 are extended between the handgrip 42 and the framed foot 51 located at the same side of the base 5 to provide sufficient supporting force. A user may grip at the handgrips 42 to do some parallel bars exercises.

Moreover, two hangers 311 may be provided at a middle portion of the upper bar 31 of the swing member 3. The hanger 311 may be, for example, in the form of a lug with a central hole. A sand bag 6 or a swing 7 may be connected to the hangers 311 for a user to practice boxing or play on the swing, or do any other suitable exercises.

The present invention has been described with a preferred embodiment thereof and it is understood that many changes and modifications in the described embodiment can be carried out without departing from the scope and the spirit of the invention as defined by the appended claims.

What is claimed is:

1. A horizontal bar, comprising:

two side supports, each having a locating hole at an upper end thereof, the locating holes of the respective side supports being symmetrical;

a top bar connected to the upper end of said side supports, by extending two outer ends thereof through the respective locating holes; and a swing member including horizontally paralleled upper and lower bars spaced from each other by a plurality of connecting plates vertically extended therebetween, said upper bar being a hollow tubular member for putting around said top bar, and said lower bar being covered with a sleeve;

wherein each of said locating holes is provided with threaded holes, via which screws are extended into said locating holes to press against and thereby locate said top bar in place.

2. The horizontal bar as claimed in claim 1, wherein each locating hole is defined in a hollow locating sleeve connected to the upper ends of the respective side supports.

3. A horizontal bar, comprising:

two side supports, each having a locating hole at an upper end thereof, the locating holes of the respective side supports being symmetrical;

a top bar connected to the upper end of said side supports, by extending two outer ends thereof through the respective locating holes; and a swing member including horizontally paralleled upper and lower bars spaced from each other by a plurality of connecting plates vertically extended therebetween, said upper bar being a hollow tubular member for putting around said top bar, and said lower bar being covered with a sleeve;

wherein said upper bar of said swing member has two spaced hangers connected to a middle portion thereof.

4. The horizontal bar as claimed in claim 3, wherein said hangers are adapted to hold a swing thereto.

5. The horizontal bar as claimed in claim 3, wherein said two hangers are adapted to hold a sand bag thereto.

6. The horizontal bar as claimed in claim 3, wherein each locating hole is defined in a hollow locating sleeve connected to the upper end of the respective side supports.

7. A horizontal bar, comprising:

two side supports, each having a locating hole at an upper end thereof, the locating holes of the respective side supports being symmetrical;

a top bar connected to the upper end of said side supports, by extending two outer ends thereof through the respective locating holes; and a swing member including horizontally paralleled upper and lower bars spaced from each other by a plurality of connecting plates vertically extended therebetween, said upper bar being a hollow tubular member for putting around said top bar, and said lower bar being covered with a sleeve;

wherein said top bar is provided near each outer end with two diametrically opposite holes for a pin to extend therethrough, said pins preventing said top bar from axially moving relative to said side supports.

8. The horizontal bar as claimed in claim 7, wherein each locating hole is defined in a hollow locating sleeve connected to the upper end of the respective side supports.

* * * * *